US006629616B1

(12) United States Patent
Heinzle

(10) Patent No.: US 6,629,616 B1
(45) Date of Patent: Oct. 7, 2003

(54) STAND FOR BAR-SHAPED OR PLATE-SHAPED OBJECTS

(76) Inventor: Egon Heinzle, Nr. 250, Laterns (AT), A-6832

( * ) Notice: Subject to any disclaimer, the term of this patent is extended or adjusted under 35 U.S.C. 154(b) by 0 days.

(21) Appl. No.: 09/701,944

(22) PCT Filed: Jun. 8, 1999

(86) PCT No.: PCT/EP99/03942

§ 371 (c)(1),
(2), (4) Date: Apr. 26, 2001

(87) PCT Pub. No.: WO99/64123

PCT Pub. Date: Dec. 16, 1999

(30) Foreign Application Priority Data

Jun. 9, 1998 (DE) ..... 198 25 815

(51) Int. Cl.[7] ..... A47F 7/00
(52) U.S. Cl. ..... 211/85.7
(58) Field of Search ..... 211/85.7, 70.5, 211/60.1, 62, 67, 69.8, 70.6, 13.1

(56) References Cited

U.S. PATENT DOCUMENTS 2,467,873 A 4/1949 Weir
2,956,687 A 10/1960 Robichaud
3,220,558 A 11/1965 Olsson
3,893,606 A * 7/1975 Hofmann ..... 211/70.5
4,190,182 A 2/1980 Hickey
4,479,584 A * 10/1984 Raz ..... 211/89.01

FOREIGN PATENT DOCUMENTS

| | | |
|---|---|---|
| DE | 3616718 | 11/1987 |
| EP | 0191891 | 6/1986 |
| EP | 0381224 | 8/1990 |
| EP | 0406179 | 1/1991 |
| FR | 2622827 | 12/1989 |

* cited by examiner

*Primary Examiner*—Alvin Chin-Shue
*Assistant Examiner*—Sarah Purol
(74) *Attorney, Agent, or Firm*—Volpe and Koenig, P.C.

(57) ABSTRACT

The invention relates to a stand (1) for inserting or placing bar-shaped or plate-shaped objects (2), e.g. skis, snowboards or the like, in which these objects (2) are inserted through a receiving opening (3) of the stand (1). The receiving opening (3) can be at least partially closed by means of strip-like, elastically bendable retaining elements (4, 5). When inserting or placing corresponding objects (2), the retaining elements (4, 5) provided on the receiving opening (3) are elastically bent outward in the area of said objects (2). The retaining elements (4, 5) which remain in the resting position thereof and which are adjacent to the retaining elements (4, 5) that are bent outward form the lateral support for the object (2) placed inside the inventive stand.

18 Claims, 7 Drawing Sheets

Figure 1:
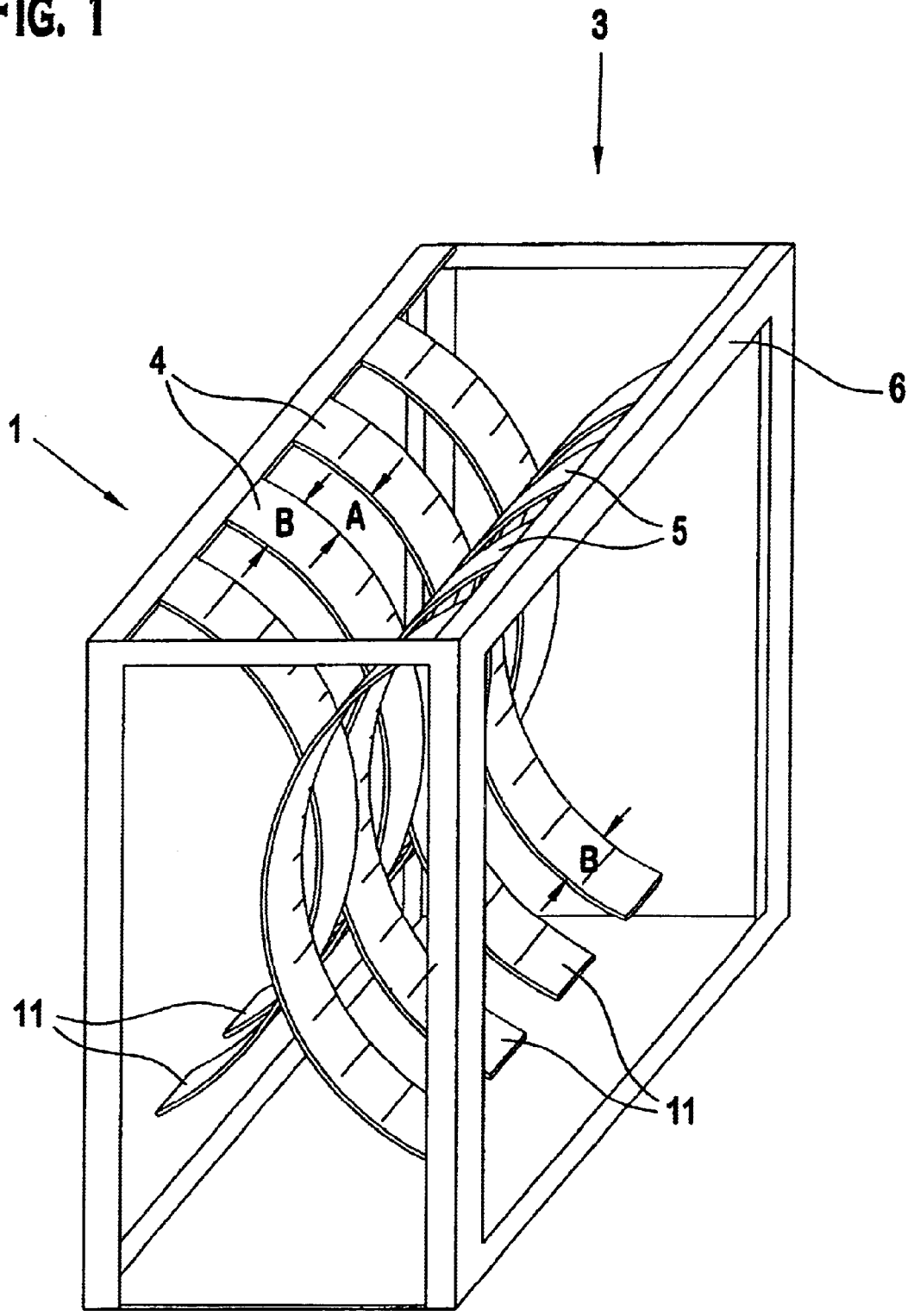

FIG. 4
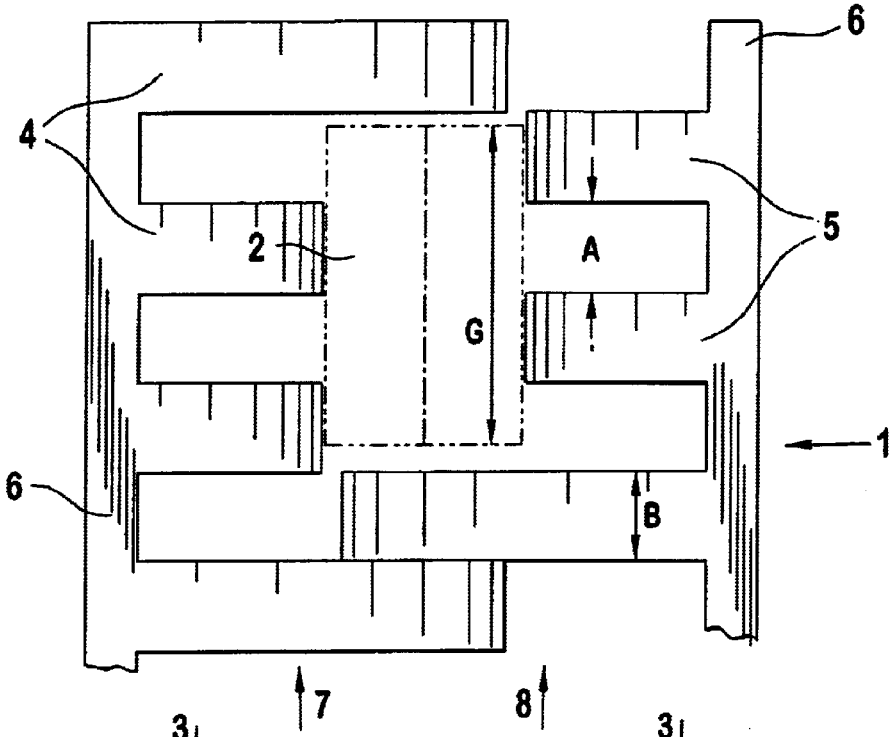
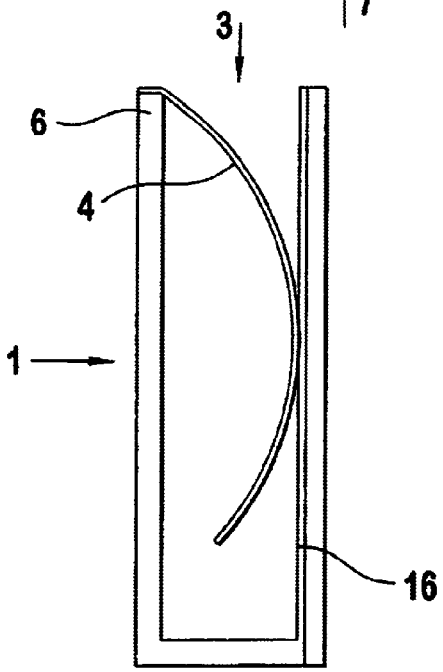
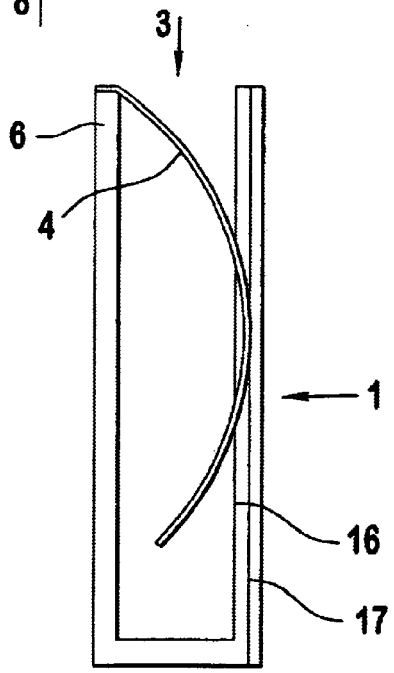
FIG. 9
FIG. 10

STAND FOR BAR-SHAPED OR PLATE-SHAPED OBJECTS

The invention relates to a stand for bar-shaped or plate-shaped objects such as skis, snowboards or the like.

Several stands are already known in the art wherein in most embodiments the objects to be received, for example, skis, snowboards or the like, are clamped in wallholders between two interacting, optionally eccentrically supported securing jaws (for example, EP-A-0381224 or EP-B-0191891). Several embodiments of stands are also known in which the receiving openings for insertion or placement of such objects are provided wherein these receiving openings must essentially be matched to the objects to be inserted. For example, a ski or a pair of skis can be inserted into each receiving opening. In order for the edge areas of the objects to be inserted not to be damaged, these receiving openings are often provided with a rubber or plastic lining. However, into these receiving openings, only skis of a similar size or, as mentioned, snowboards of a similar size or other objects with approximately identical size can be placed since the size of the receiving opening is predetermined.

Moreover, several holders for skis and optionally also additionally for ski poles are known (for example, DE-A-3616718, U.S. Pat. No. 4190182 or EP-A-0406179) in order to be able to better hand-carry a pair of skis. In this connection, a ski is clamped between two elastically bendable jaws which are connected by a transverse stay to form a kind of U-shaped profile. The possibility of a safe securing of rod-shaped or plate-shaped objects, such as skis, snowboards or the like, in a stand for receiving several objects is not possible in such a manner. Such a configuration of the prior art known in the context of individual holders for carrying skis is not suitable for an automatic adaptation to different thicknesses and widths of objects in a stand.

It is therefore an object of the present invention to provide a stand of the aforementioned kind in which objects of different thickness dimensions and width dimensions can be inserted and, despite this, can be secured safely.

This is achieved according to the invention by a plurality of approximately parallel extending strip-like, rod-like, or finger-like elastically bendable and/or springably movable or pivotable retaining elements which are elastically bent away by the insertion of the objects and/or are springably moved backward.

With these inventive measures it is possible to provide a relatively long receiving opening so that within a large area most different objects can be inserted or placed. The most diverse objects can be inserted independent of the width of the objects, viewed in the longitudinal direction of the receiving opening, without constructive changes on the stand and can be secured safely in their position. The position-secured holding action has become possible exactly because only those retaining elements which are present in the direct insertion area of an object at the receiving opening are elastically bent or springably moved or pivoted by the object. The retaining elements which remain in the rest position directly on both sides adjacent to the inserted object thus form a lateral stop. Each inserted or placed object is so to speak clamped by the springy retaining elements and the directly laterally adjacently positioned retaining elements provide a lateral limitation of each directly opened part of the entire receiving opening. Accordingly, no attention must be paid to where an object, for example, a ski, is inserted relative to the longitudinal extension of the receiving opening. In each insertion area, relative to the entire length of the receiving opening, the same conditions are present.

Moreover, it is suggested that the width of the retaining elements is substantially smaller than the width of the objects to be inserted. Accordingly, for each object to be inserted several retaining elements are pushed away elastically so that mostly several retaining elements are supported springably or elastically on the surface of the inserted object. When a plurality of retaining elements is provided, it is then ensured that the lateral stops in the form of the retaining elements that have not been pushed away are positioned relatively closely to the lateral borders of the inserted objects and thus further improve the position-secured holding action.

A constructively simple design of the stand is provided when the retaining elements are arc-like extending, strip-like or rod-like parts of spring steel or of a spring-elastic plastic material. The manufacture is then relatively easy to accomplish and, moreover, the action is optimal. By means of the arc-shaped design it is also ensured that the object to be inserted does not contact sharp edges or cutting edges. Moreover, pulling out of the object from the stand is also possible without hindrance and without damaging the possibly sensitive surface of the objects.

Moreover, it is suggested that the retaining elements are fastened on a longitudinal boundary of the receiving opening of the stand and project into the stand with arc-shaped extension and supported in a springy manner on the inner boundary of the stand facing away from the fastening side. This can be the simplest constructive solution because only on one side of the receiving opening such retaining elements must be mounted. The object to be inserted is then pressed by means of the springably pushed-away retaining elements against the oppositely positioned boundary of the receiving opening of the stand. However, also with such a simple embodiment only those retaining elements are pushed back elastically which are in the direct effective area of the object to be inserted.

A special embodiment variant suggests that the retaining elements are arranged successively at a spacing to one another and aligned parallel to one another. Especially in the case of correspondingly narrow retaining elements or in the case of relatively wide objects that are constantly being inserted, the number of required retaining elements can thus be reduced.

Especially for only a one-sided arrangement of the retaining elements, the spring travel and thus also the spring action of the individual retaining elements can be further enhanced and, moreover, the lateral stop area for the inserted objects can be enlarged when the retaining elements with their arc-shaped portions engage partially in slots of the inner boundary of the stand facing away from the fastening side.

One special embodiment variant suggests that two oppositely positioned rows of retaining elements are provided which intermesh in a comb-like way. A corresponding pressure is thus exerted onto the inserted objects from both sides and thus a correspondingly excellent holding action is realized. The lateral stops, depending on the width of the object to be inserted, are then formed by retaining elements of one or the other row. The retaining element which forms directly the lateral stop is furthermore supported by the successively arranged retaining elements engaging in a comb-like fashion.

In order to ensure a simple but still effective construction of the stand, it is proposed that the retaining elements at their ends are connected in the area of the receiving opening of the stand fixedly with the stand or are connected fixedly to the stand by means of a stay adjoining the retaining elements. This ensures the required excellent fastening of the retaining element, in particular, in the areas which are loaded most during insertion or placement of an object or also during pulling out of an object.

In order to obtain a sufficiently elastic spring action of the retaining elements, it is advantageous when the ends of the retaining elements that protrude into the stand from the fastening location in the area of the receiving opening project freely. This ensures that, despite a sufficient spring force, an easy insertion of the object into the stand can be performed because the counter force of the retaining element in the direction of its freely projecting end becomes smaller and smaller.

One embodiment suggests that the ends of several or all retaining elements projecting into the stand are connected fixedly with one another or by means of a continuous stay. With this measures a plurality of retaining elements can be easily manipulated which is beneficial in regard to a simple mounting but also in regard to service and repair work. Especially when the objects to be inserted are relatively long objects, which are to be received by a stand, i.e., in particular, for example, in the case of the skis or snowboards, an even better position securing action can be achieved when several retaining units, formed of two rows of retaining elements, respectively, intermeshing with one another in a comb-like fashion, are successively arranged in the insertion direction of the objects.

In this connection, it can also be provided that the successively arranged retaining elements are arranged staggered by the width of a retaining element. Accordingly, retaining elements correlated with one or the other side provide lateral supports for the inserted objects.

In this connection, the effect is especially advantageous when the freely projecting ends of the retaining elements of one retaining unit engage in a comb-like fashion the slots arranged between two respective retaining elements of the respective successive retaining unit. Accordingly, the retaining elements correlated with an upper retaining unit are guided at least with their free ends between two retaining elements of the retaining unit positioned underneath and can thus not deflect laterally.

In a special constructive design of the retaining elements it is also possible that both ends of the retaining elements are connected fixedly with the stand, respectively, or are connected by means of a stay adjoining the retaining elements to the stand. This results in a type of springy deformation of the retaining elements during insertion of an object into the stand, wherein for this construction also very special cross-sectional shapes and a special curvature of the retaining elements are advantageous.

One of these possibilities is seen in that the retaining elements are bent to a circular ring or are manufactured of tubular elements with cuts for forming the retaining elements. In such variants not only simple manufacturing possibilities result but also a simple exchangeability and thus a simple stock holding.

In the context of the invention, however, a different kind of embodiment is also possible which, in principle, allows also other constructive variants. For this purpose it is suggested that each individual one of the retaining elements is fastened moveably in a springy fashion at the lateral boundaries of the receiving opening of the stand. With these retaining elements the same effect is achieved with respect to the springy holding action of the objects to be inserted and with respect to the lateral support of the object by the first retaining elements not springably moved back.

The special stability of the retaining elements and thus also an optimal holding action of the objects to be inserted is achieved when the free ends of the freely projecting retaining elements engage in slots or grooves which are essentially adjusted to their width.

A further design suggests that the retaining elements are formed of partial sections connected in a parallelogram shape. In this way, the spring action and also the adjusting travel of the individual retaining elements can be adjusted to even greater objects to be inserted.

Moreover, an embodiment of the stand is possible in which on one side retaining elements with arc-shaped portions and on the other side straight retaining elements are provided which are supported springably or intermesh with one another in a comb-like fashion. In this way, one or more retaining elements are supported all-over on one side of the object to be inserted while on the opposite side only an area of the arc-shaped portion of the retaining element is supported.

Figure 2:
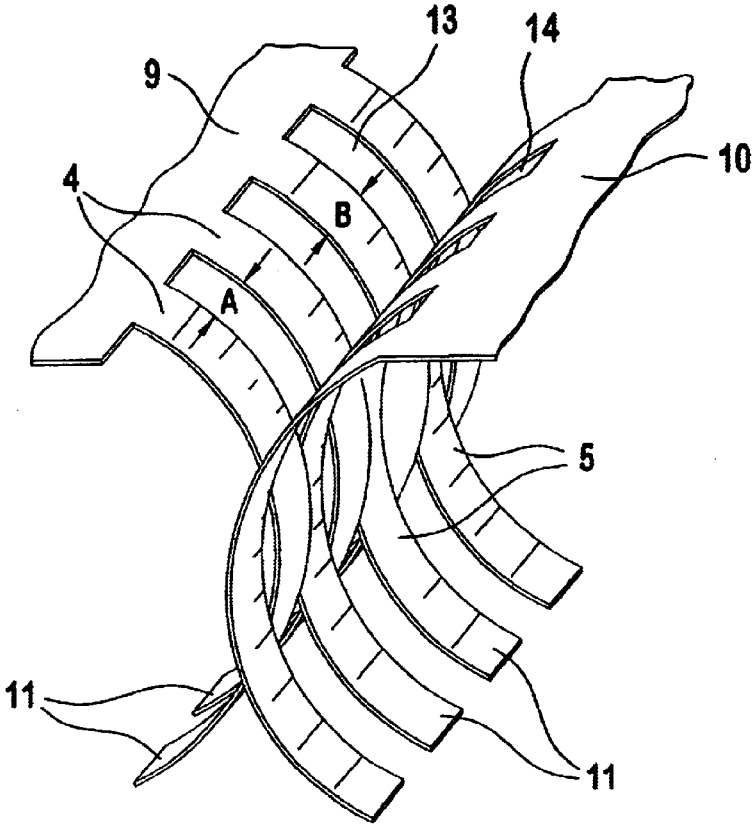
Figure 3:
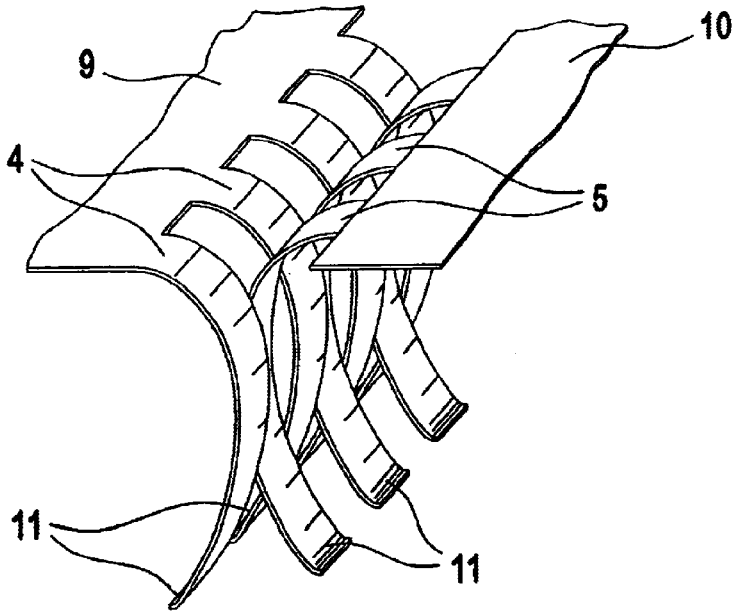
Figure 7:
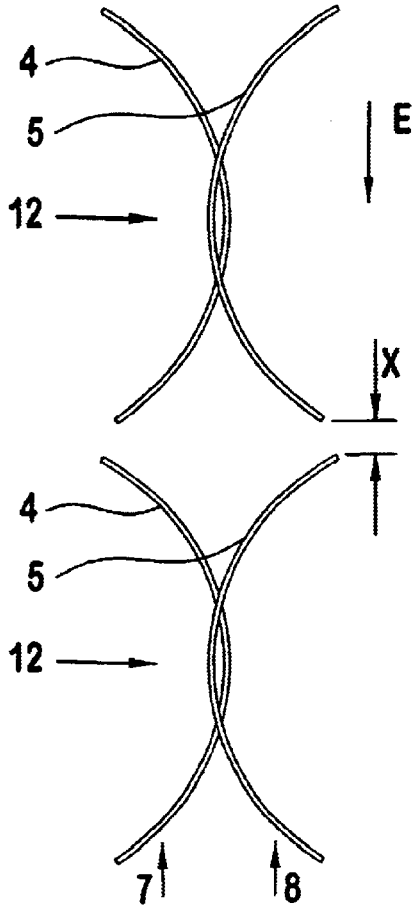
Figure 6:
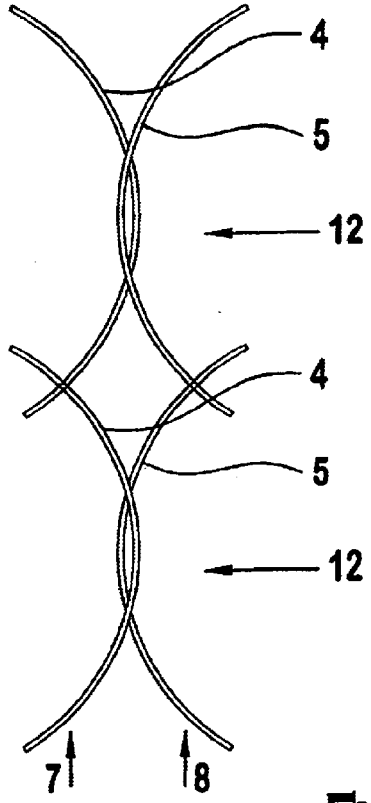
Figure 5:
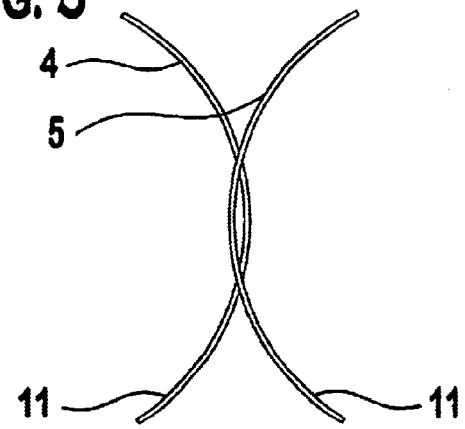
Figure 8:
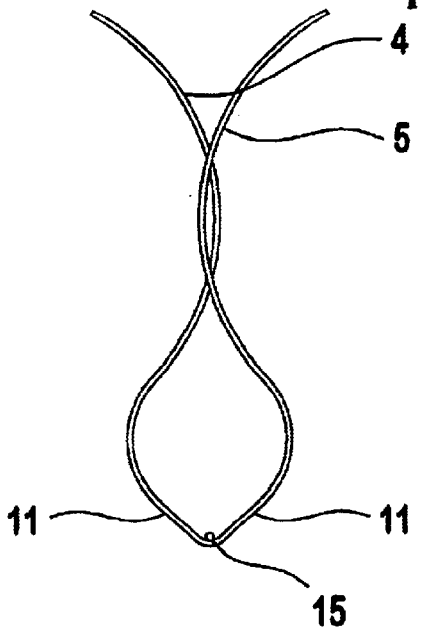
Figure 11:
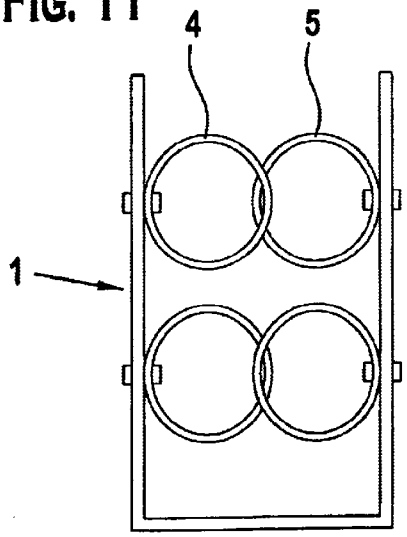
Figure 12:
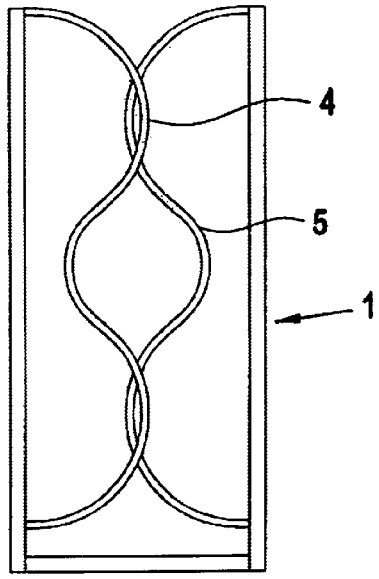
Figure 13:
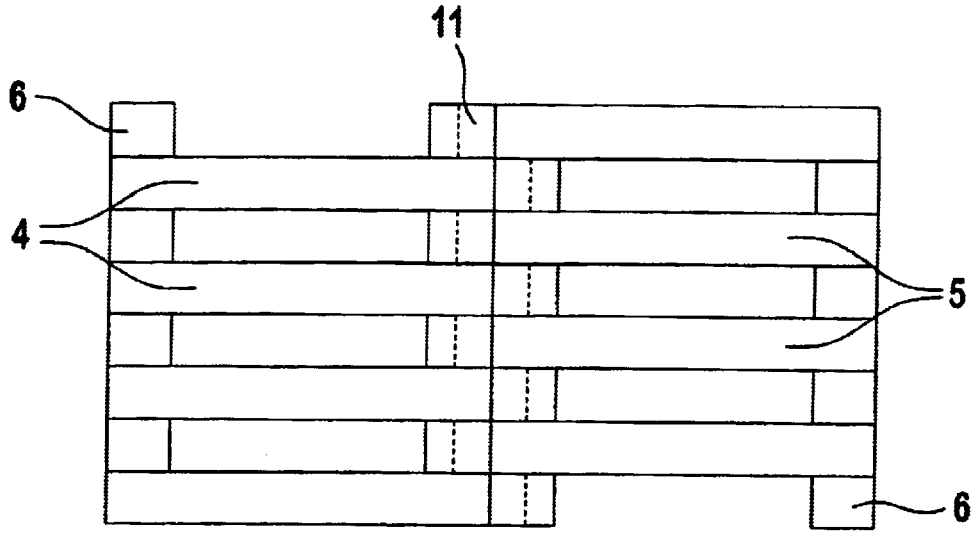
Figure 14:
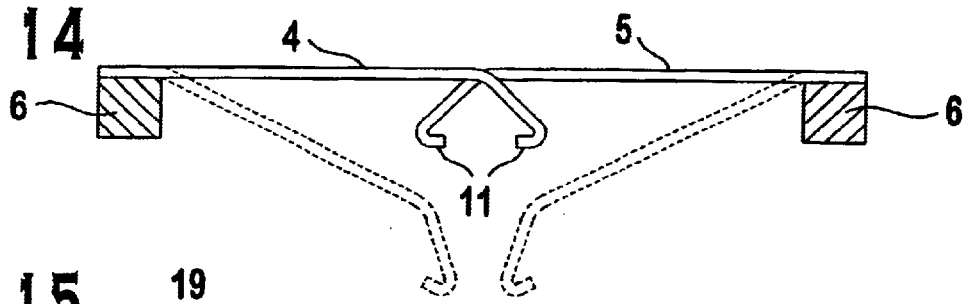
Figure 15:
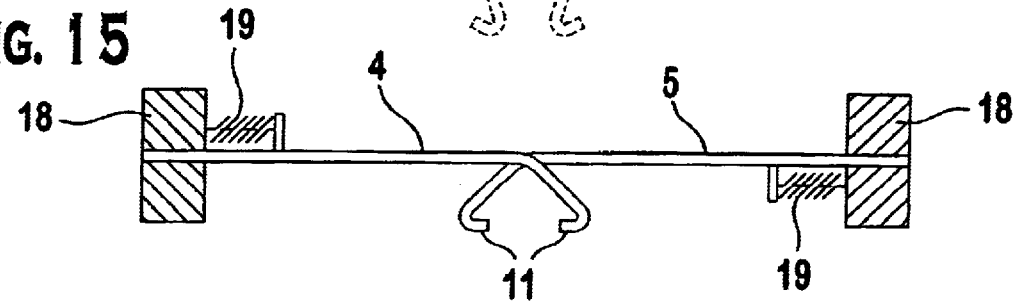
Figure 16:
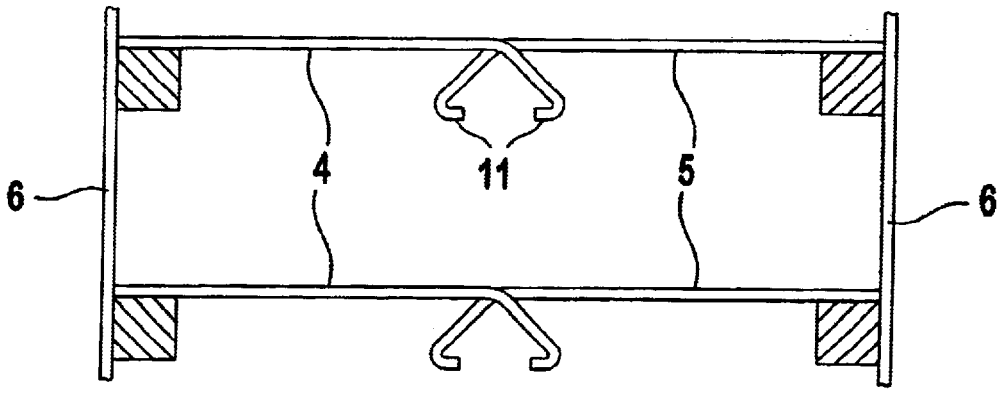

Further features and special advantages according to the invention will be explained in more detail in the following description with the aid of the drawings. It is shown in:

| | |
|---|---|
| FIG. 1 | a perspective view of a stand with inserted retaining elements in a schematic illustration; |
| FIG. 2 | retaining elements of a series which with their one ends adjoin a stay in a monolithic fashion; |
| FIG. 3 | an illustration identical to that of FIG. 2, wherein however the retaining elements have a different curvature; |
| FIG. 4 | a plan view onto a stand with inserted object to be secured; |
| FIG. 5 | a schematic illustration of a side view of two series of retaining elements which intermesh with one another in a comb-like fashion; |
| FIG. 6 | two retaining units arranged above one another and engaging with their portions facing one another, the retaining units each comprised of two series of retaining elements intermeshing with one another in a comb-like fashion; |
| FIG. 7 | two retaining units arranged at a minimal spacing above one another, the retaining units each comprised of two series of retaining elements intermeshing with one another in a comb-like fashion; |
| FIG. 8 | an embodiment of two series of retaining elements intermeshing with one another in a comb-like fashion and connected with one another at their lower ends directly or by means of a stay; |
| FIG. 9 | one embodiment with retaining elements arranged only at one side of the stand and with an oppositely positioned planar end surface; |
| FIG. 10 | an embodiment variant with retaining elements arranged only at one side of the stand and with an oppositely positioned planar end surface which has slots for a comb-like intermeshing with the retaining elements; |
| FIG. 11 | an embodiment with approximately circular arc-shaped retaining elements; |
| FIG. 12 | an embodiment with specially curved retaining elements, wherein both ends thereof are fixedly connected with the stand; |
| FIG. 13 | a plan view of a schematic illustration of an embodiment in which retaining element approximately positioned in a common plane are provided with free end portions bent at an acute angle in the downward direction; |
| FIG. 14 | a side view of the embodiment according to FIG. 13; |
| FIG. 15 | a further embodiment of a stand in a side view identical to that of FIG. 14, in which the retaining elements are positioned in their plane so as to be springably slidable; |
| FIG. 16 | one embodiment of a stand as in FIG. 15 wherein however two identical arrangements are mounted above one another; |

-continued

Figure 17:
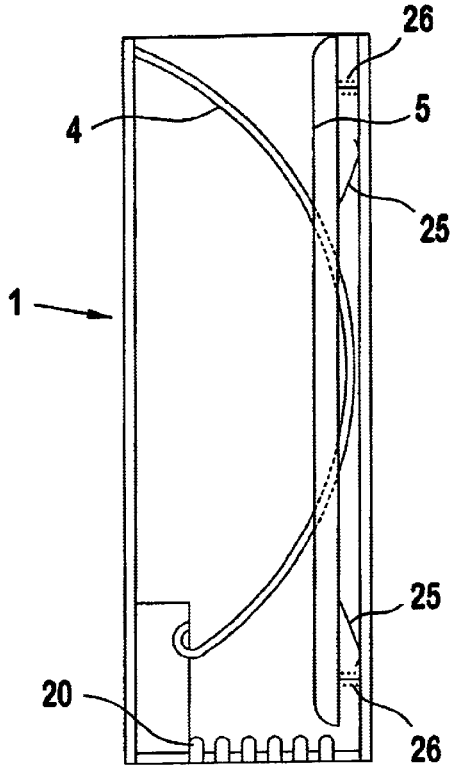
Figure 18:
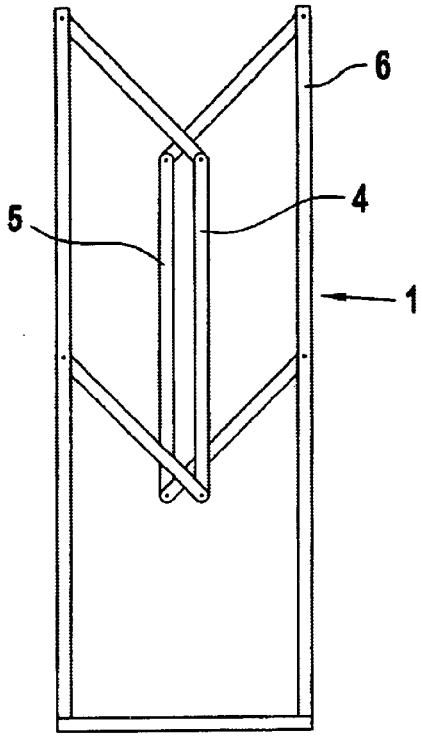
Figure 19:
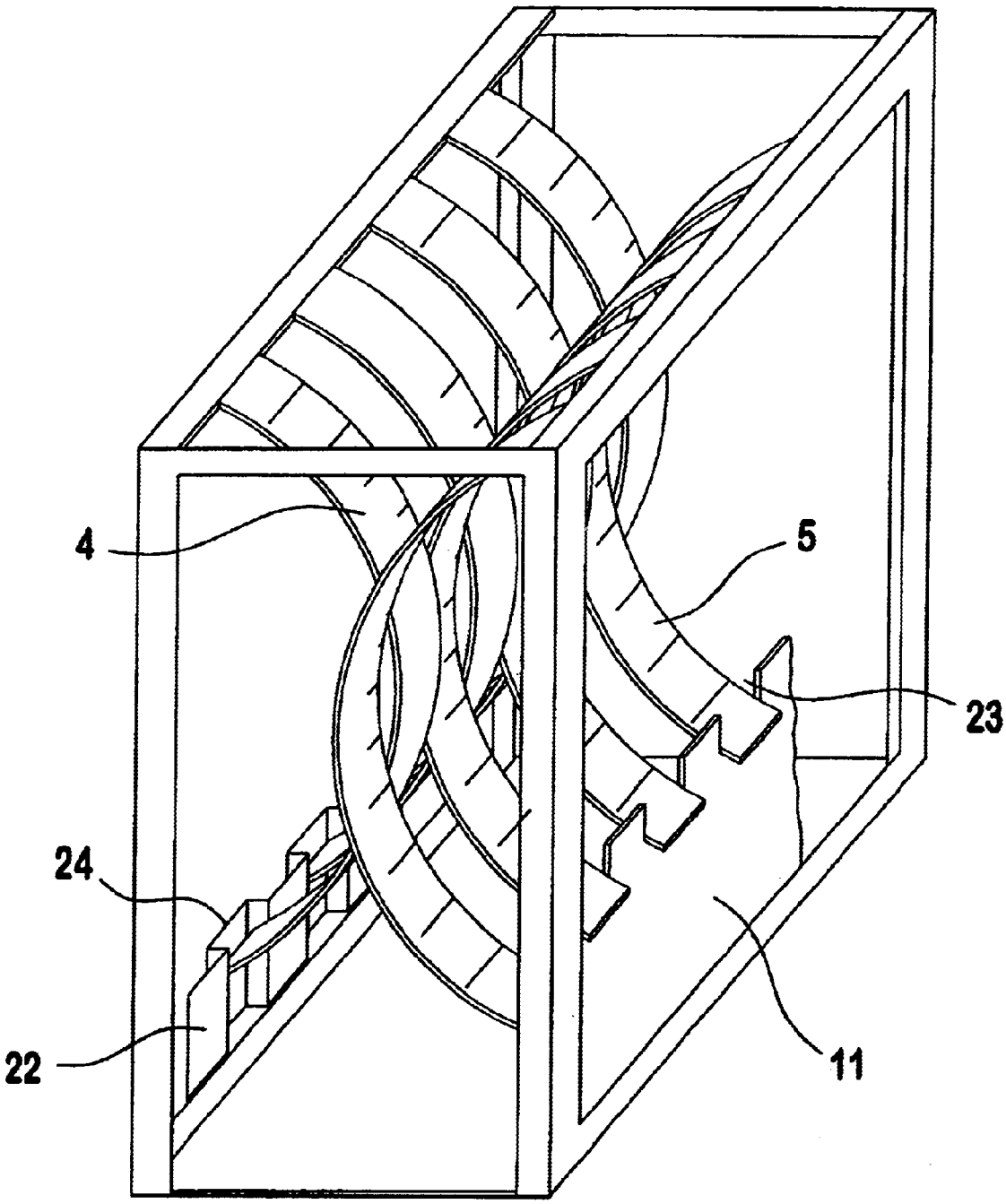

| | |
|---|---|
| FIG. 17 | one embodiment with retaining elements with arc-shaped portions and planar retaining elements; |
| FIG. 18 | one embodiment with retaining elements which are formed of partial sections connected with one another in a parallelogram shape; |
| FIG. 19 | a stand in which two embodiment variants for guiding the freely projecting ends of the retaining elements can be seen. |

In a stand 1 for insertion or placement of rod-shaped, plate-shaped or profile-shaped objects 2, the objects 2 are to be secured approximately in vertical orientation relative to the front and to the back as well as to the sides. Such stands 1 are used for insertion of, for example, skis, snowboards or the like, but also for other types of rod-shaped, plate-shaped or profile-shaped objects 2, also, for example, profiled rods, boards, device parts (for example, also device handles) and the like. In this connection, such a stand 1, as illustrated in FIG. 1, can be arranged in this vertical orientation but also in any desired angular position. Even for a horizontal position, i.e., when the objects 2 are inserted in an approximately horizontal direction, a stand 1 with the features according to the invention can be optimally used. In the illustration in FIG. 4, even an object 2 comprised of a pair of skis is inserted.

The objects are inserted through a receiving opening 3 into the stand 1 wherein the receiving opening 3 can be closed at least partially by means of strip-like, rod-like or finger-like elastically bendable and/or springably moveable retaining elements 4 or 5. These retaining elements are mounted on a frame 6 of the stand 1. When inserting or placing objects 2, the retaining elements 4 and 5, present in the area of the objects 2 at the receiving opening 3, are elastically bent away and/or springably moved back.

Advantageously, a plurality of substantially parallel extending retaining elements 4 or 5 are provided whose width B is substantially smaller than the width G of the objects 2 to be inserted. The width of the retaining elements 4, 5 can be different and, in the case of receiving always very wide objects 2, the retaining elements 4, 5 can also be designed to be accordingly wider. Also, within one stand 1 different retaining elements of different widths can be provided or the retaining elements 4, 5 arranged successively have in one and the same stand different spacings A from one another.

The stand 1 itself or its frame 6 can be made of metal or of plastic material. The retaining elements 4, 5 can also be formed of parts of spring steel or of a spring-elastic plastic material, the parts extending arc-shaped, being strip-shaped or rod-shaped.

The retaining elements 4, 5 are positioned at a spacing A from one another successively and aligned parallel to one another. Accordingly, inter alia, two oppositely positioned rows 7, 8 of retaining elements 4, 5 can be provided which intermesh with one another in a comb-like fashion. The retaining elements 4, 5 are connected fixedly to the stand 1 or the frame 6 with their ends in the area of the receiving opening 3 of the stand 1 or are connected to the stand 1 or the frame 6 by means of a stay 9, 10 adjoining the retaining elements 4, 5.

For the spring behavior of the retaining elements 4, 5 it is positive when the ends 11 of the retaining elements 4, 5 protruding from the fastening location at the frame 6 into the stand 1 in the area of the receiving opening 3 project freely. As can be seen in FIGS. 1, 2, and 5, in these embodiments—but also in the case of other illustrated variants—the retaining elements 4, 5 are curved to follow a circular arc. As can be seen in particular in FIG. 3, the curvature of the retaining elements 4, 5 can have a different course. Each type of curvature, for example, also an elliptical course, or any other type of planar or curved portions adjoining one another angularly is conceivable wherein transitions between individual portions expediently have a curved transition in order to thus facilitate the insertion of the objects 2 into the stand 1 and to also reliably prevent damaging of the objects 2 to be inserted.

In the embodiment according to FIGS. 6 and 7, several retaining units 12 comprised each of two comb-like intermeshing series 7, 8 of retaining elements 4, 5 are arranged successively in the insertion direction E for the objects 2. Such an arrangement is shown in FIG. 6 wherein the two retaining units follow successively with minimal spacing X. In such an arrangement of two retaining units 12 above one another it is especially suitable in the embodiment according to FIG. 7 to stagger the successively arranged retaining units 12 by a width B of a retaining element 4, 5 relative to one another. In this case, it is then possible for the freely projecting ends 11 of the retaining elements 4, 5 of one retaining unit 12 to engage in a comb-like fashion the slots 13, 14 between two retaining elements 4, 5 of the respectively following retaining units 12. The freely extending ends 11 of the retaining elements 4, 5 thus provide an additional lateral support.

In the embodiment according to FIG. 8, the ends 11 projecting into the stands 1 of several or all retaining elements 4, 5 are fixedly connected with one another or by a continuous stay 15. In general, this is a corresponding stay 15, or a connecting stay is present which connects all or some retaining elements 4, 5 as a unitary part.

In the embodiment according to FIG. 9 and FIG. 10, stands 1 are illustrated in which retaining elements 4, 5 are arranged only at one side. The retaining elements 4, 5 are fastened at the longitudinal boundary of the receiving opening 3 of the stand 1 or on the frame 6 and extend arc-shaped and bulging to the opposite inner boundary 16. In the configuration according to FIG. 9 the object 2 to be inserted is thus clamped between the retaining elements 4, 5 and the inner boundary 16. The retaining elements 4, 5 are supported springably at the inner boundary 16 of the stand 1 facing away from the fastening side. In the embodiment according to FIG. 10, the retaining elements 4, 5 engage with their arc-shaped portions partially in slots 17 at the inner boundary 16 of the stand 1 facing away from the fastening side.

In the embodiment according to FIG. 17 a similar design as that in FIGS. 9 and 10 is shown wherein, however, in addition to the springably embodied retaining elements 4 provided with an arc-shaped portion also planar, i.e., straight, retaining elements 5 are provided. These retaining elements 5 and the retaining elements 4 can be supported directly on one another or also intermesh with one another in a comb-like way. The springs 15 can be provided in the form of leaf springs 25. For securing the retaining elements 5 guide pins 26 are provided wherein also in the area of these guide pins springs in the form of coil springs can be provided. At the bottom of this stand knobs 20 are provided to support the objects to be inserted in a protected way in order to also provide here an additional holding action against lateral tilting of the objects.

FIG. 11 shows one embodiment variant in which the retaining elements 4, 5 are bent to a circular ring, respectively, are manufactured of tubular elements with cuts for formation of the retaining elements 4, 5. Upon insertion of the object, these retaining elements 4, 5 are elastically deformed to a shape deviating from the circular shape, i.e., similar to a ball which is loaded by standing on it. When pulling out the object, a deformation in the opposite direction occurs. In this embodiment, as in the embodiment according to FIG. 6, the retaining elements 4, 5 arranged above one another can intermesh with one another.

In the embodiment according to FIG. 12 the two ends of the retaining elements 4, 5 are fixedly connected with the stand 1, respectively, or are connected to the stand 1 by means of a stay adjoining the retaining elements, 4, 5. Here also a corresponding deformation and movement of the retaining elements 4, 5 upon insertion of an object 2 occurs.

In the construction according to FIGS. 13 and 14, the retaining elements 4, 5 extends substantially straight in a plane wherein only their end portions 11 are bent at an acute angle in the downward direction. Upon insertion of an object 2 the retaining elements 4, 5 bend elastically in the downward direction (shown in dashed lines in FIG. 14). In this case, the retaining elements which are positioned laterally adjacent to the downwardly curved retaining elements 4, 5 and remain straight provide the lateral stops for the objects. In such embodiment, however, it is expedient to arranged at least two retaining units above one another, except when at the support bottom of the stand corresponding counter holders are provided in order to prevent tilting of the inserted objects 2.

In the embodiment according to FIG. 15 each of the individual retaining elements are mounted slidably in a springable fashion at the lateral boundaries 18 of the receiving opening 3 of the stand 1. Here, the retaining elements 4, 5 are not elastically deformed but, for example, against the force of a spring 19 which can engage at the upper side or the underside of the retaining elements 4, 5, are forced outwardly so that the object to be inserted can be received. In such a variant a one-sided or, as shown, two-sided arrangement with opposite comb-like engagement is also possible. Here, the retaining elements 4, 5 that are not moved back provide also the lateral stop for the inserted object.

The embodiment according to FIG. 16 is constructed in the same way as FIG. 15 wherein, however, two planes of retaining elements 4, 5 are mounted above one another in a stand. The objects to be inserted are secured in two areas which are arranged above one another at a spacing so that an especially excellent tilting safety is provided.

In the embodiment according to FIG. 19 it can be seen how the stability of the freely projecting retaining elements 4, 5 can be further improved. In this connection, two embodiments are illustrated. At the left side the free ends of the retaining elements 4 engage in grooves 24 of a profiled rail 22. At the opposite side it is shown that it is also possible to provide slots 23 only in a sidewall 21 of the stand in which the free ends of the retaining elements 5 engage. The stability of the retaining elements transverse to their longitudinal extension and transverse to their bending direction is thus significantly improved.

FIG. 18 shows an embodiment variant in which the retaining elements 4, 5 are comprised of partial sections which are connected or joined to one another in a parallelogram shape. In this connection, between the partial sections rotary axles or joints can be provided, or unitary parts bent of spring steel or a spring-elastic plastic material are provided. In the embodiment of individual partial sections springs are to be arranged additionally at corresponding locations. For such a construction the objects to be inserted can be secured over a relatively large planar area.

A stand according to the invention can be employed in most variants, because of its simple and robust design, also when exposed to the elements and, in particular, also in winter where it is important to be able to insert continuously and without problems gliding winter sport apparatus. For a disturbance-free operation of a stand according to the invention, it may be further beneficial when the lateral edge areas of the individual retaining elements are rounded or angled. An even more improved embodiment results when the retaining elements 4, 5, after pulling out an object that had been inserted, are to intermesh again in a comb-like manner.

A stand according to the invention can have a single, optionally very long, receiving opening with a plurality of retaining elements. However, it is also conceivable to provide a stand with several receiving openings which however also have a length for receiving several objects. Also, a design is possible in which the receiving opening has the width of only one object to be inserted wherein the receiving elements then provide the spring action on the object. However, the optimal possibility of lateral support by means of the respective adjacently positioned retaining elements is no longer available.

In the context of the invention it is however also possible to adjust the width of the retaining elements approximately to the width or thickness of the objects to be inserted so that such a stand can also be used for relatively thin or narrow objects, for example, for device sticks (broom sticks and the like) . In this connection, the retaining elements can be positioned opposite one another and can be supported on one another springably so that the object to be inserted is supported on both sides accordingly. On both lateral areas supporting retaining elements for the lateral holding action are also provided, respectively.

The support surface for the object inserted into the stand, i.e., in general the bottom of the stand, should be designed such that the object cannot easily be moved laterally and such that water can flow out. The bottom could, for example, be provided with knobs, pins or brushes. The bottom can also be of a planar design and can be horizontally extending or slantedly extending at an acute angle to the horizontal. The bottom can, however, also be curved in cross-section or also can be comprised of portions which adjoin at an acute or obtuse angle so that a type of groove results.

What is claimed is:

1. A stand for objects in the form of skis and/or snowboards, comprising two confronting retaining means adapted to receive said objects through insertion between said means, at least one of said retaining means being in the form of a plurality of approximately parallel, aligned strip-like, rod-like or finger-like elastically bendable and optionally resiliently movable or pivotable refining elements (4, 5) responsive to said object insertion to be elastically bent away from the other of said two retaining means and projecting from a common support (6) toward said other retaining means, wherein the embodiment of the stand for skis and snowboards the width (B) of the retaining elements (4, 5) is substantially smaller than the width (G) of the skis to be inserted and wherein in the embodiment of the stand for snowboards the width (B) of the retaining elements (4, 5) is substantially smaller than the width (G) of the snowboards to be inserted.

2. The stand according to claim 1, wherein the retaining elements (4, 5) are formed as arc-shaped extending, strip-like or rod-like parts of spring steel or of a spring-elastic plastic material.

3. The stand according to claim 1, wherein the retaining elements (4, 5) are fastened on a fastening side on a longitudinal boundary of the receiving opening (3) of the stand (1) and project into the stand (1) with arc-shaped extension and with springable support on the inner boundary (16) of the stand (1) facing away from the fastening side.

4. The stand according to claim 1, wherein the retaining elements (4, 5) are arranged at a spacing (A) successively to one another.

5. The stand according to claim 3, wherein the retaining elements (4, 5) with their arc-shaped portions engage partially in slots (17) at the inner boundary, (16) of the stand (1) facing away from the fastening side.

6. The stand according to claim 1, wherein two oppositely arranged rows (7, 8) of retaining elements (4, 5) are provided which intermesh with one another in interleaving comb-like fashion.

7. The stand according to claim 1, wherein the retaining elements (4, 5) at one of their ends are fixedly connected to the stand (1) in the area of the receiving opening (3) of the stand (1) or fixedly connected to the stand (1) by means of a stay (9, 10) adjoining the retaining elements (4, 5).

8. The stand according to claim 1, wherein the ends (11) protruding into the stand (1) of several or all retaining elements (4, 5) are fixedly connected with one another or are connected to one another by means of a continuous stay (15).

9. The stand according to claim 1, wherein several retaining units (12), each comprised of two comb-like intermeshing rows (7, 8) of retaining elements (4, 5) are successively arranged in the insertion direction (E) for the objects (2).

10. The stand according to claim 9, characterized in that the successively arranged retaining units (12) are staggered relative to one another by the width (B) of a retaining element (4, 5).

11. The stand according to claim 10, characterized in that the freely projecting ends (11) of the retaining elements (4, 5) of the one retaining unit (12) intermesh in a comb-like fashion with the slots (13, 14) between two retaining elements (4, 5) of the respectively successively arranged retaining unit (12).

12. The stand according to claim 1, wherein the ends (11) of the retaining elements (4, 5) protruding into the stand (1) project freely from the fastening location.

13. The stand according to claim 1, wherein respectively both ends of the retaining elements (4, 5) are fixedly connected with the stand (1) or connected to the stand (1) by means of a stay (9, 10) adjoining the retaining elements (4, 5).

14. The stand according to claim 13, characterized in that the retaining elements (4, 5) are bent to a circular ring or produced of tubular elements with cuts for forming the retaining elements (4, 5).

15. The stand according to claim 1, wherein each individual one of the retaining elements (4, 5) is springably slidably mounted on the lateral boundaries of the receiving opening (3) stand (1).

16. The stand according to claim 12, characterized in that the free ends of the freely projecting retaining elements (4, 5) intermesh with slots (23) or grooves (24) adjusted substantially to the width thereof.

17. The stand according to claim 1, wherein the retaining elements (4, 5) are formed of partial sections connected in a parallelogram shape to one another.

18. The stand according to claim 1, wherein on one side the retaining elements (4) are provided with arc-shaped portions and on the opposite side with retaining elements (5) extending straight which are supported springably on one another or intermesh with one another springably in a comb-like manner.

* * * * *